US005879479A

United States Patent [19]

Nabeshima et al.

[11] Patent Number: 5,879,479

[45] Date of Patent: Mar. 9, 1999

[54] METHOD OF MAKING ULTRA LOW-CARBON STEEL

[75] Inventors: Seiji Nabeshima; Hakaru Nakato, both of Okayama; Kenichi Sorimachi, Chiba, all of Japan

[73] Assignee: Kawasaki Steel Corporation, Japan

[21] Appl. No.: 784,833

[22] Filed: Jan. 17, 1997

[30] Foreign Application Priority Data

Jan. 19, 1996 [JP] Japan ..... 8-007771

[51] Int. Cl.[6] ..... C22C 38/00; C21D 9/00

[52] U.S. Cl. ..... 148/541; 148/625; 164/55.1; 164/56.1; 164/57.1; 164/58.1

[58] Field of Search ..... 148/541, 579, 148/602, 603, 681, 625; 164/55.1, 56.1, 57.1, 58.1

[56] References Cited

FOREIGN PATENT DOCUMENTS

| | | |
|---|---|---|
| 0 101 740 A1 | 3/1984 | European Pat. Off. . |
| 0 177 851 A1 | 4/1986 | European Pat. Off. . |
| 0 375 273 A2 | 6/1990 | European Pat. Off. . |
| 0 572 666 A1 | 12/1993 | European Pat. Off. . |
| 3528782 A1 | 2/1987 | Germany . |
| 407268440 | 10/1995 | Japan . |

*Primary Examiner*—Sikyin Ip
*Attorney, Agent, or Firm*—Austin R. Miller

[57] ABSTRACT

Adding aluminum and/or silica to molten steel after decarburization containing about 0.005 percent by weight or less of carbon and about 1.0 percent by weight or less of manganese to form a mildly deoxidized molten steel; adding titanium to the mildly deoxidized molten steel to continue deoxidation so that the molten steel contains about 0.005 percent by weight or less of aluminum, about 0.20 percent by weight or less of silicon and about 0.01 to 0.10 percent by weight of titanium, to form inclusions in the molten steel which essentially consist of a complex oxide of titanium and aluminum, a complex oxide of titanium and silicon, and/or a complex oxide of titanium, aluminum and silicon.

4 Claims, 3 Drawing Sheets

METHOD OF MAKING ULTRA LOW-CARBON STEEL

BACKGROUND OF THE INVENTION

1. Field of the Invention

The present invention relates to a method of making an ultra low-carbon cold-rolled steel sheet, capable of preventing the usual upper nozzle, sliding nozzle and immersion nozzle of a tundish ("nozzles") from clogging. Such clogging often occurs during continuous casting of aluminum-killed molten steel due to $Al_2O_3$ adhesion to the inner walls of these nozzles. The method of this invention is also capable of minimizing or preventing occurrence of surface defects on the slabs that are produced by the continuous casting process. Such surface defects have, in the past, been due to $Al_2O_3$ clusters which inevitably formed in the aluminum-killed molten steel. This invention is also capable for the first time of preventing defects due to $Al_2O_3$ in cold-rolled steel sheets produced from such slabs.

2. Description of the Related Art

In manufacturing ultra low-carbon cold-rolled steel sheets, aluminum is generally added to the molten steel after decarburization to decrease the soluble oxygen content in the molten steel, and to increase the yield achievable by Ti and Nb to precipitate and fix carbon and nitrogen in the steel during melting. Aluminum addition is also done in order to prevent blow holes from forming on the surface of the slab during continuous casting. When such aluminum-killed steel is subjected to continuous casting, $Al_2O_3$-based oxides tend to be formed during deoxidation and tend to adhere to the inner walls of the nozzles of the tundish and clog the nozzles. Thus, the available channel for molten metal flow is narrowed and prevents achievement of the desired flow molten metal rate. Further, when pieces of $Al_2O_3$ peel off the inner walls of the nozzles, they are captured by coagulated shells in the cast slab, resulting in surface defects in the slab.

Efforts have been made to solve such problems. One has been to blow inert gas such as gaseous argon from the nozzles of the tundish to prevent $Al_2O_3$-based oxide adhesion to the inner walls of the nozzles. However, blown inert gas is captured by coagulated shells in the slab and results in formation of new bubble defects in the slab.

There are other disclosed methods for attempting to reduce $Al_2O_3$ adhesion to the inner walls of the nozzles, in which metallic or alloyed calcium such as Ca—Si is added to the molten steel to convert $Al_2O_3$ inclusions to CaO-$Al_2O_3$ inclusions having lower melting points, as follows:

1) Japanese Unexamined Patent Publication No. 58-154447 discloses a method in which 0.2 to 0.5 kg/t of calcium is added to molten metal in a ladle so as to decrease the melting point of $Al_2O_3$ inclusions, in which the resulting CaO-$Al_2O_3$ melt rises to the surface of the molten steel and is removed from the ladle.
2) Japanese Unexamined Patent Publication No. 61-276756 discloses a method in which metallic or alloyed calcium is added to aluminum-killed molten metal during a melting or continuous casting step so that 2 to 40 ppm of calcium, which forms CaO-$Al_2O_3$ inclusions, remains in the steel.

However, calcium added as metallic or alloyed calcium is converted to CaS and CaO, which results in development of rust on the steel sheet. In particular, rust readily forms at a calcium content of 10 ppm or more in steel. Further, portions of $Al_2O_3$ formed during the aluminum-deoxidation process, which did not rise to the surface in the tundish and casting mold, remained as large coagulated inclusions in the cast slab. Such inclusions were captured on the surface layer of the cast slab, resulting in serious surface defects.

SUMMARY OF THE INVENTION

It is accordingly an object of the present invention to provide a method of making an ultra low-carbon cold-rolled steel sheet, free from nozzle clogging during a continuous casting process of titanium-containing aluminum-killed steel, to produce a cast slab that is free from surface defects.

It is another object of the present invention to provide a method of making a cold-rolled steel sheet having deep drawability, in which types of oxide inclusions in the steel are controlled for preventing tundish nozzle clogging and for preventing surface defects of the cast slab, and in which the cold-rolled steel sheet is continuously annealed at a temperature range from about 700° C. to its $A_{c3}$ transformation point.

BRIEF SUMMARY OF THE INVENTION

The method of making an ultra low-carbon cold-rolled steel sheet in accordance with the present invention comprises adding aluminum and/or silica to molten steel after decarburization, such molten steel containing about 0.005 percent by weight or less of carbon and about 1.0 percent by weight or less of manganese to form a semi-deoxidized molten steel; adding metallic and/or alloyed titanium to the semi-deoxidized molten steel to continue deoxidation so that the molten steel contains about 0.005 percent by weight or less of aluminum, about 0.1–0.20 percent by weight of silicon and about 0.01 to 0.10 percent by weight of titanium, to produce inclusions in the molten steel which essentially consist of complex oxide of titanium and aluminum, complex oxide of titanium and silicon, and/or complex oxide of titanium, aluminum and silicon; continuously casting the molten steel followed by hot-rolling and cold-rolling; and continuously annealing the cold-rolled steel sheet.

The cold-rolled steel sheet should be continuously annealed within a temperature range from about 700° C. to its $A_{c3}$ transformation point.

Metallic and/or alloyed niobium may be added to the titanium-deoxidized molten steel so that the niobium content in the molten steel is about 0.03 percent by weight or less.

Metallic and/or alloyed boron may be added to the titanium-deoxidized molten steel so that the boron content in the molten steel is about 0.002 percent by weight or less.

Metallic and/or alloyed niobium and metallic and/or alloyed boron may be added to the titanium-deoxidized molten steel so that the niobium content in the molten steel is about 0.03 percent by weight or less and the boron content in the molten steel is about 0.002 percent by weight or less.

In accordance with the method of the present invention, tundish nozzle clogging is prevented without gas blowing during continuous casting, and a cold-rolled steel sheet having no surface defects and excellent mechanical properties is obtainable from the resulting slab.

DESCRIPTION OF THE PREFERRED EMBODIMENTS

Figure 1:
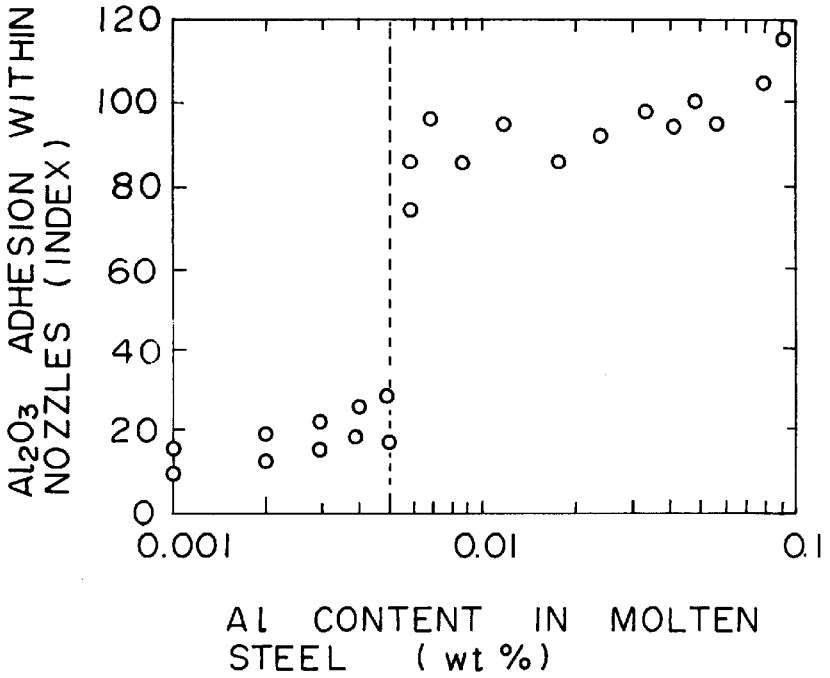
FIG. 1 is a graph illustrating the correlation between aluminum content in molten steel and the $Al_2O_3$ adhesion (index) to the inner walls of tundish nozzles.

This invention relates to production of ultra low-carbon steel. The expression "ultra low-carbon" means a carbon content of about 0.005 percent by weight or less, achieved usually by decarburization under vacuum.

For production of ultra low-carbon cold-rolled steel for formation into sheet, the manganese content in molten steel tapped from the ladle is controlled to about 0.05–1.0 percent by weight, and the carbon content of the steel is controlled to about 0.005 percent by weight or less, usually by application of a vacuum. Manganese is added if necessary as a reinforcing component of the steel in a preferable amount to achieve a molten steel percentage of about 0.05–1.0 percent by weight. Too much manganese inhibits chemical conversion treatment and workability. When the carbon content of the steel exceeds about 0.005 percent by weight, the recrystallization temperature rises, and elongation (El) and deep drawability (r-value) decrease. Thus, the upper limit of the carbon content is about 0.005 percent by weight and the lower limit is substantially zero.

The balance of the steel comprises iron and incidental impurities. The upper limits of phosphorus and sulfur contents as incidental impurities are controlled to about 0.030 percent by weight and about 0.020 percent by weight, respectively.

The molten metal which was decarburized to an ultra low-carbon steel has a high soluble oxygen content of several dozen ppm. The soluble oxygen content has been conventionally decreased by addition of about 0.010 percent by weight or more of aluminum. Aluminum oxide ($Al_2O_3$) forms during deoxidation treatment. Portions of $Al_2O_3$ which did not rise up or form during re-oxidation of the molten metal, tends to cause tundish nozzle clogging in the continuous casting step. Further, the aluminum oxide tends to grow to clusters having sizes of several hundred $\mu$m, and to form surface defects on the cast slab and on the resulting cold-rolled sheet.

In the present invention the aluminum content in the molten steel is significantly reduced in order to suppress $Al_2O_3$ formation. The resulting inclusions are selected from the group consisting of complex oxides of titanium and aluminum, complex oxides of titanium and silicon, and/or complex oxides of titanium, aluminum and silicon, instead of aluminum oxide ($Al_2O_3$). It is preferred that the titanium oxide content of the steel be in the range of about 30 to 95 percent by weight and that its $Al_2O_3$ content be in the range of about 30 percent by weight or less.

By forming complex oxide inclusions in the forms set forth above, formation of $Al_2O_3$ clusters has been discovered not to occur, and tundish nozzle clogging and surface defects of the cold-rolled sheet are effectively suppressed. If the aluminum content exceeds about 0.005 percent by weight in the molten steel, the aluminum oxide content in inclusions undesirably exceeds about 30 percent by weight. As a result, inclusions tend to become clustered to sizes of about 100 $\mu$m or more, resulting in surface defects of the slab and cold-rolled steel sheet, adhesion to the inner walls of the nozzles, and nozzle clogging.

According to this invention about 0.005 percent by weight or less of aluminum is added to reduce the soluble oxygen content in the present invention. Such a low aluminum content is not sufficient to completely reduce the soluble oxygen content of the steel. According to this invention titanium or a titanium-containing alloy is added to achieve titanium-deoxidation. An important novel component of the resulting inclusions is a complex oxide of titanium and aluminum whose inclusions do not grow to form large clusters, and no significant surface defects occur in the slab or in the cold-rolled steel sheet as a result. Nozzle clogging is significantly prevented.

In the present invention silicon is preferably added before titanium oxidation. The resulting inclusions then exist primarily as a complex oxide of titanium and silicon and a complex oxide of titanium, aluminum and silicon, and the formation of undesirable clusters is effectively reduced or eliminated.

The inclusions in accordance with the present invention preferably contain about 30 to 95 percent by weight of titanium oxides and about 30 percent by weight or less of $Al_2O_3$. When the $Al_2O_3$ content exceeds about 30 percent by weight, undesirably large clusters tend to be formed. A titanium oxide content of over about 95 percent by weight also surprisingly tends to form undesirable clusters. On the other hand, a titanium oxide content of less than about 30 percent by weight in the inclusions does not result in sufficiently complete deoxidation of the steel, and the resulting molten steel has such a high soluble oxygen content as to reduce surface quality of the cold-rolled steel sheet. Thus, the titanium oxide concentration of the inclusions is preferably about 30–95 percent by weight.

Figure 2:
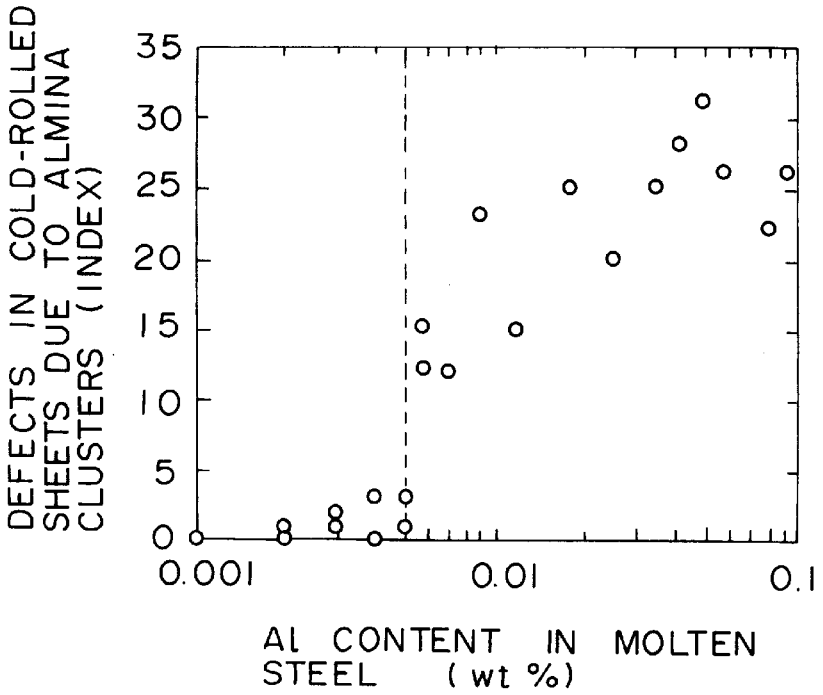
FIG. 2 is a graph illustrating the correlation between aluminum content in molten steel and surface defects (index) in cold-rolled steel sheets due to presence of $Al_2O_3$ clusters.

FIG. 1 is a graph illustrating the correlation between the aluminum content in the molten steel in conventional practice and the amount of $Al_2O_3$ adhesion to the inner walls of tundish nozzles, and FIG. 2 is a graph illustrating the correlation between the aluminum content in the molten steel and surface defects in cold-rolled steel sheets due to $Al_2O_3$ clusters. $Al_2O_3$ adhesion is represented by an index illustrating the thickness of the $Al_2O_3$ layer adhered to the inner walls of the nozzles, and the surface defects are represented by an index indicating the number of defects formed per unit length. FIGS. 1 and 2 demonstrate that nozzle clogging and surface defects in the cold-rolled steel sheet significantly decrease at an aluminum content of about 0.005 percent by weight or less.

In the treatment set forth above, a decreased amount of added aluminum results in insufficient deoxidation, increased soluble oxygen content in the molten steel and formation of blow holes on the surface of the cast slab during continuous casting. In the present invention, titanium is necessarily added for the reasons heretofore expressed and in order to prevent formation of blow holes.

Figure 3:
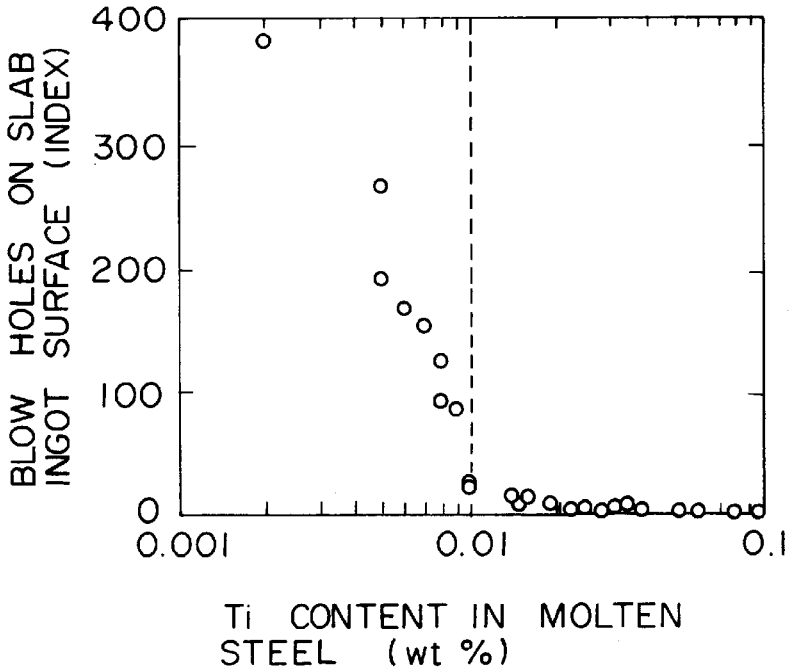
FIG. 3 is a graph illustrating the correlation between the titanium content in molten steel and formation of blow holes (index) on the surface layer of continuously cast slabs.

FIG. 3 is a graph illustrating the correlation between the titanium content in molten steel of this invention and blow holes (index) on the surface layer of continuously cast slabs. As shown in FIG. 3, formation of blow holes can be significantly decreased by controlling the titanium content in the molten metal to about 0.010 percent by weight or more. Thus, deterioration of the surface qualities of the cold-rolled steel sheet is prevented according to this invention.

Although deoxidation with titanium is effective in preventing surface defects due to the formation of undesirable clusters from inclusions in the slab and cold-rolled steel sheet, and in preventing nozzle clogging, the addition of an excessive amount of titanium tends to form titanium nitride (TiN) in the molten steel. The formed TiN adheres to the inner walls of the nozzles and is oxidized by air to form titanium oxide. Such oxidation rapidly induces nozzle clogging.

Figure 4:
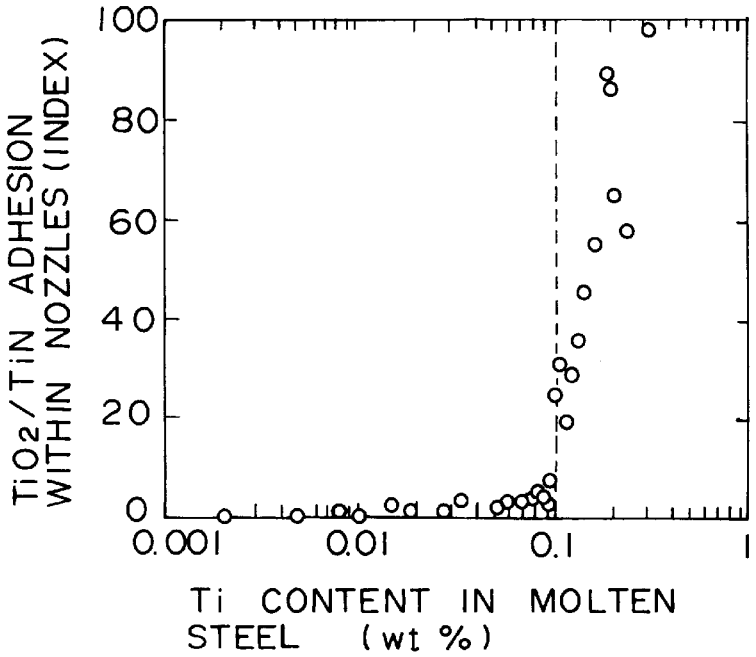
FIG. 4 is a graph illustrating the correlation between titanium content in molten steel and $TiO_2$/TiN adhesion (index) to the inner walls of nozzles.

FIG. 4 is a graph illustrating the correlation between the titanium content in the molten steel of this invention and $TiO_2$ and TiN adhesion (index) to the inner walls of tundish nozzles. FIG. 4 demonstrates that nozzle clogging rapidly proceeds at a titanium content of over about 0.100 percent by weight. Thus, the titanium content is controlled to a range from about 0.01 to 0.10 percent by weight.

Before deoxidation with a titanium alloy, an alloy or alloys containing aluminum and/or silicon is added in order to convert the composition of inclusions to a complex oxide or complex oxides and to decrease the soluble oxygen concentration before titanium-deoxidation. Because the molten steel after decarburization contains a large amount of soluble oxygen, i.e., several hundred ppm, deoxidation with titanium causes a decreased yield of titanium. Thus, a larger amount of titanium is required for deoxidation, resulting in an economic disadvantage. Further, the contents of titanium oxide and oxygen after deoxidation increase and surface defects in the cold-rolled steel sheet tend to increase. It is preferred that the aluminum content after deoxidation be about 0.001 percent by weight or more and the silicon content after deoxidation be about 0.01 percent by weight or more.

Figure 5:
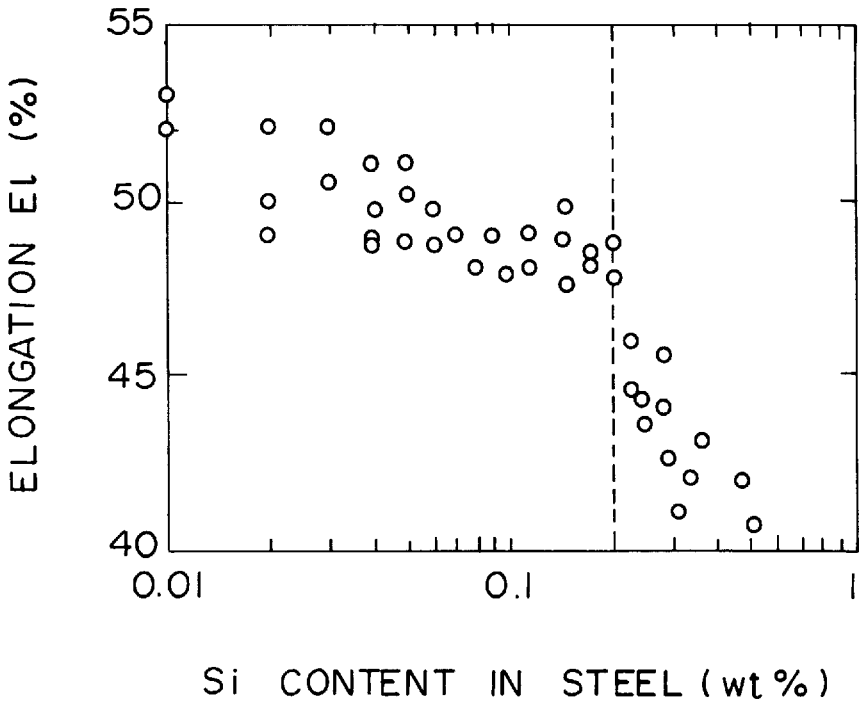
FIG. 5 is a graph illustrating the correlation between silicon content in molten steel and elongation of the resulting cold-rolled steel sheets.

On the other hand, the silicon content must be controlled to about 0.20 percent by weight or less because excessive silicon deteriorates the properties of the cold-rolled steel sheet. FIG. 5 is a graph illustrating the correlation between the silicon content in the molten steel and elongation of the cold-rolled steel sheets. As shown in FIG. 5, a significant decrease in elongation of the cold-rolled steel sheet can be prevented by reducing the silicon content to about 0.20 percent by weight or less.

It is preferred that carbon and nitrogen be fixed in the molten steel in order to improve press formability of the cold-rolled steel sheet. Since the present invention is directed to weakly deoxidized steel with a low aluminum content, carbon and nitrogen are effectively fixed with niobium, which has a lower affinity with oxygen. When the niobium content exceeds about 0.030 percent by weight, large amounts of precipitants such as NbC form as fine grains, resulting in decreased elongation and drawability (r-value). Further, excessive use of niobium causes economical disadvantages. Thus, the upper limit of the niobium to be added is controlled to about 0.03 percent by weight.

Boron is preferably added for the purpose of the improvement in work brittleness. When the boron content is excessively high, the recrystallization temperature of the steel increases and the steel is hardened. Thus, it is preferred that the boron content is about 0.002 percent by weight or less.

It is preferred that the cold-rolled steel sheet is subjected to continuous annealing within a temperature range from about 700° C. to its $A_{c3}$ transformation point for at least one second in order to improve deep drawability of the cold-rolled steel sheet. Deep drawability is effectively improved due to recrystallization during continuous annealing within a temperature range over about 700° C. for at least one second. However, deep drawability rapidly deteriorates at a temperature higher than the $A_{c3}$ point (approximately 920° C.). Thus, the upper limit is approximately the $A_{c3}$ point.

EXAMPLES

In a converter, 280 tons of molten iron were rough decarburized to approximately 0.02 to 0.1 percent by weight of carbon, and the molten steel after the adjustment of manganese content was tapped to a ladle and subjected to decarburization to an ultra low-carbon content of 0.005 percent by weight of carbon using an RH-type vacuum degassing apparatus.

Aluminum, silica and titanium were separately added to the molten steel in the amounts specified hereinafter so as to perform stepwise deoxidation. Molten steels having various compositions as shown in Table 1 were prepared in such a manner. Some of the molten steels further containing the indicated amounts of niobium and/or boron were prepared in the same manner.

Each molten steel was cast to a slab with a cross-section of 220 mm by 1650 mm using a two-strand continuous slab casting machine, capable of containing as much as 60 tons of molten steel in the tundish, at a molten metal heating temperature of 15° to 30° C. and a casting speed of 2.5 m/min. An $Al_2O_3$-graphite refractory was used for the tundish nozzles.

After continuous casting, presence or absence of adhesion of inclusions to the refractory walls of the nozzles was observed. The results are shown in Table 1.

The continuously cast slab was reheated to 1,200° C., subjected to finishing hot rolling at 900° C., and coiled at 600° C. The steel sheet was pickled and subjected to cold rolling at a reduction rate of 80%. The cold-rolled sheet was annealed at 700° to 900° C. for 40 seconds, and subjected to finishing rolling of 0.5%. After the resulting cold-rolled sheet was subjected to galvanizing, it was subjected to mechanical tests and surface observation. Results are shown in Table 2, wherein the surface conditions are expressed as indices.

TABLE 1-1

(wt %)

| No | C | Si | Mn | P | S | Al | N (ppm) | Ti | Nb | B | Annealing Temperature (°C.) | Remarks |
|---|---|---|---|---|---|---|---|---|---|---|---|---|
| A | 0.0015 | 0.06 | 0.15 | 0.012 | 0.008 | 0.001 | 0.0025 | 0.018 | — | — | 750 | Examples |
| B | 0.0023 | 0.02 | 0.14 | 0.01 | 0.007 | 0.003 | 0.0026 | 0.029 | 0.005 | — | 789 | Examples |
| C | 0.0028 | 0.12 | 0.16 | 0.009 | 0.009 | 0.002 | 0.0021 | 0.038 | — | — | 812 | Examples |
| D | 0.0019 | 0.18 | 0.16 | 0.012 | 0.008 | 0.002 | 0.0020 | 0.04 | — | — | 762 | Examples |
| E | 0.003 | 0.05 | 0.15 | 0.008 | 0.007 | 0.003 | 0.0018 | 0.042 | — | — | 795 | Examples |
| F | 0.0023 | 0.07 | 0.18 | 0.009 | 0.009 | 0.002 | 0.0031 | 0.088 | — | — | 815 | Examples |
| G | 0.0035 | 0.03 | 0.18 | 0.013 | 0.006 | 0.004 | 0.0026 | 0.025 | 0.008 | — | 737 | Examples |
| H | 0.0014 | 0.09 | 0.16 | 0.007 | 0.009 | 0.003 | 0.0019 | 0.055 | — | — | 865 | Examples |
| I | 0.006 | 0.02 | 0.16 | 0.009 | 0.008 | o.002 | 0.0025 | 0.036 | — | — | 775 | Comparative Ex. |
| J | 0.003 | 0.06 | 0.16 | 0.0012 | 0.006 | 0.006 | 0.0026 | 0.035 | — | — | 768 | Comparative Ex. |

TABLE 1-2

(wt %)

| No | C | Si | Mn | P | S | Al | N (ppm) | Ti | Nb | B | Annealing Temperature (°C.) | Remarks |
|---|---|---|---|---|---|---|---|---|---|---|---|---|
| K | 0.0026 | 0.15 | 0.19 | 0.011 | 0.01 | 0.012 | 0.0023 | 0.039 | — | — | 770 | Comparative Ex. |
| L | 0.003 | 0.07 | 0.18 | 0.01 | 0.008 | 0.035 | 0.0019 | 0.028 | — | — | 795 | Comparative Ex. |
| M | 0.0019 | 0.22 | 0.18 | 0.009 | 0.009 | 0.003 | 0.0019 | 0.037 | — | — | 782 | Comparative Ex. |
| N | 0.0028 | 0.32 | 0.19 | 0.008 | 0.008 | 0.002 | 0.0027 | 0.038 | — | — | 790 | Comparative Ex. |
| O | 0.0032 | 0.07 | 0.16 | 0.007 | 0.009 | 0.004 | 0.0025 | 0.007 | — | — | 780 | Comparative Ex. |
| P | 0.0032 | 0.03 | 0.15 | 0.01 | 0.007 | 0.003 | 0.0026 | 0.112 | — | — | 765 | Comparative Ex. |
| Q | 0.0024 | 0.07 | 0.19 | 0.012 | 0.006 | 0.002 | 0.0031 | 0.035 | — | — | 680 | Comparative Ex. |
| R | 0.0035 | 0.1 | 0.18 | 0.008 | 0.005 | 0.003 | 0.0025 | 0.039 | — | — | 950 | Comparative Ex. |
| S | 0.0020 | 0.05 | 0.09 | 0.008 | 0.006 | 0.002 | 0.0028 | 0.048 | — | 0.001 | 780 | Comparative Ex. |
| T | 0.0025 | 0.02 | 0.10 | 0.009 | 0.008 | 0.002 | 0.0025 | 0.039 | 0.005 | 0.0005 | 800 | Comparative Ex. |

TABLE 2

| No | Nozzle clog-ging | Surface defects in cold-rolled sheet (Index) | Blow Holes (Index) | Elong-ation (%) | Tensile strength T.S. (MPa) | r-value | Remarks |
|---|---|---|---|---|---|---|---|
| A | none | 0 | 12 | 49 | 335 | 1.85 | Example |
| B | none | 2 | 11 | 51 | 331 | 1.89 | Example |
| C | none | 0 | 7 | 50 | 335 | 1.87 | Example |
| D | none | 1 | 6 | 48 | 340 | 1.88 | Example |
| E | none | 1 | 8 | 49 | 332 | 1.92 | Example |
| F | none | 1 | 6 | 49 | 340 | 1.88 | Example |
| G | none | 2 | 9 | 50 | 331 | 1.94 | Example |
| H | none | 1 | 11 | 49 | 341 | 1.89 | Example |
| I | none | 1 | 8 | 41 | 361 | 1.52 | * Comp. |
| j | ** | 15 | 2 | 51 | 332 | 1.88 | * Comp. |
| K | ** | 23 | 1 | 51 | 335 | 1.9 | * Comp. |
| L | ** | 32 | 0 | 49 | 340 | 1.87 | * Comp. |
| M | none | 1 | 10 | 42 | 365 | 1.89 | * Comp. |
| N | none | 1 | 12 | 38 | 330 | 1.87 | * Comp. |
| O | none | 2 | 153 | 44 | 343 | 1.65 | * Comp. |
| P | ** | 2 | 2 | 50 | 342 | 1.75 | * Comp. |
| Q | none | 1 | 8 | 40 | 364 | 1.48 | * Comp. |
| R | none | 2 | 12 | 50 | 328 | 1.38 | * Comp. |
| S | none | 0 | 3 | 51 | 330 | 1.90 | * Comp. |
| T | none | 0 | 5 | 50 | 340 | 1.92 | * Comp. |

* Comp. means "Comparative Example".
** means "observed"

The results shown in Table 2 demonstrate that the method in accordance with the present invention is free from tundish nozzle clogging, does not form significant surface defects in the cold-rolled steel sheet, and possesses excellent mechanical properties.

Wherever reference is made in the specification or claims to the addition of elements such as alumina, silica, manganese, titanium, aluminum, niobium or boron, it will be understood that this includes the use of the elemental form or of alloys or compounds or combinations of more than one of such elements, or their equivalents, introduced individually or together.

What is claimed is:

1. A method of making ultra low-carbon steel comprising:

in a separate step adding aluminum and/or silica to decarburized molten steel containing about 0.005 wt % or less of carbon and about 0.5–1.0 wt % or less of manganese to reduce the oxygen content of said molten steel;

sequentially in another separate step adding titanium to said molten steel of reduced oxygen content to conduct further deoxidation until said molten steel contains about 0.005 wt % or less of aluminum, about 0.20 wt % or less of silicon and about 0.01 to 0.10 wt % of titanium;

wherein inclusions are formed in said steel, said inclusions comprising titanium oxide and aluminum oxide, and wherein the ratio of titanium oxide in said inclusions is about 30 to 95 % by weight and the ratio of aluminum oxide in said inclusions is about 30% by weight or less, based on the total of titanium oxide plus aluminum oxide in said inclusions; and thereafter continuously casting the resulting molten steel by hot rolling and cold rolling the cast steel and continuously annealing the resulting cold-rolled steel sheet within a temperature range from about 700° C. to its $A_{c3}$ transformation point.

2. A method of making an ultra low-carbon steel according to claim 1, wherein niobium is added to the titanium-deoxidized steel in an amount to provide a niobium content of about 0.03 percent by weight or less.

3. A method of making an ultra low-carbon steel according to claim 1, wherein boron is added to the titanium-deoxidized steel in an amount to provide a boron content of about 0.002 percent by weight or less.

4. A method of making an ultra low-carbon steel according to claim 1, wherein niobium and boron are added to the titanium-deoxidized steel to provide a niobium content of about 0.03 percent by weight or less and a boron of about 0.002 percent by weight or less.

* * * * *